US011594162B2

(12) United States Patent
Li et al.

(10) Patent No.: US 11,594,162 B2
(45) Date of Patent: Feb. 28, 2023

(54) METHOD AND DEVICE FOR DETECTING DISPLAY SUBSTRATE

(71) Applicants: Hefei Xinsheng Optoelectronics Technology Co., Ltd., Anhui (CN); BOE TECHNOLOGY GROUP CO., LTD., Beijing (CN)

(72) Inventors: Guangyao Li, Beijing (CN); Yuankui Ding, Beijing (CN); Liusong Ni, Beijing (CN); Jun Wang, Beijing (CN); Haitao Wang, Beijing (CN); Dongfang Wang, Beijing (CN)

(73) Assignees: Hefei Xinsheng Optoelectronics Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/435,297

(22) PCT Filed: Jan. 6, 2021

(86) PCT No.: PCT/CN2021/070486

§ 371 (c)(1),
(2) Date: Aug. 31, 2021

(87) PCT Pub. No.: WO2021/139686

PCT Pub. Date: Jul. 15, 2021

(65) Prior Publication Data

US 2022/0157212 A1 May 19, 2022

(30) Foreign Application Priority Data

Jan. 6, 2020 (CN) ..... 202010009304.X

(51) Int. Cl.
*G09G 3/00* (2006.01)
*G09G 3/36* (2006.01)

(52) U.S. Cl.
CPC ..... *G09G 3/006* (2013.01); *G09G 3/36* (2013.01); *G09G 2300/0842* (2013.01);
(Continued)

(58) Field of Classification Search
CPC .. G09G 3/006; G09G 3/36; G09G 2300/0842; G09G 2310/08; G09G 2320/0233; G09G 2320/029
(Continued)

(56) References Cited

U.S. PATENT DOCUMENTS 9,230,474 B2 * 1/2016 Jin ..... G09G 3/006
10,739,655 B2 8/2020 Ju
(Continued)

FOREIGN PATENT DOCUMENTS

CN 1804647 A 7/2006
CN 101387764 A 3/2009
(Continued)

OTHER PUBLICATIONS

China Patent Office, First Office Action dated Feb. 24, 2021, for corresponding Chinese application No. 202010009304.X.
(Continued)

*Primary Examiner* — Tom V Sheng
(74) *Attorney, Agent, or Firm* — Houtteman Law LLC

(57) ABSTRACT

The present disclosure provides a method for detecting a display substrate and a device for detecting a display substrate. The method includes: exciting a threshold voltage of a driving transistor in each pixel driving circuit in the display substrate, so that the threshold voltage of the driving transistor with a shifted threshold voltage is further shifted; inputting a detection signal to each pixel driving circuit in the display substrate, where the detection signal is a signal enabling the pixel driving circuit to operate normally; and
(Continued)

judging whether the display substrate is normal or not according to the voltage output by each pixel driving circuit.

12 Claims, 5 Drawing Sheets

(52) U.S. Cl.
CPC ... *G09G 2310/08* (2013.01); *G09G 2320/029* (2013.01); *G09G 2320/0233* (2013.01)

(58) Field of Classification Search
USPC ..... 345/690
See application file for complete search history.

(56) References Cited

U.S. PATENT DOCUMENTS

| | | | | |
|---|---|---|---|---|
| 2011/0080173 | A1* | 4/2011 | Kim | G09G 3/006 324/403 |
| 2012/0147070 | A1* | 6/2012 | Segawa | G09G 3/006 345/694 |
| 2012/0306939 | A1* | 12/2012 | Choi | G09G 3/006 345/77 |
| 2015/0145754 | A1* | 5/2015 | Yang | G09G 3/3233 345/76 |
| 2016/0343278 | A1* | 11/2016 | Tsujita | G09G 3/3266 |
| 2018/0061312 | A1 | 3/2018 | He et al. | |
| 2020/0394965 | A1* | 12/2020 | Yuan | G09G 3/3208 |

FOREIGN PATENT DOCUMENTS

| | | | |
|---|---|---|---|
| CN | 103572240 | A | 2/2014 |
| CN | 106128342 | A | 11/2016 |
| CN | 106200085 | A | 12/2016 |
| CN | 107610629 | A | 1/2018 |
| CN | 107680522 | A | 2/2018 |
| CN | 107863055 | A | 3/2018 |
| CN | 108053785 | A | 5/2018 |
| CN | 109767975 | A | 5/2019 |
| CN | 110070833 | A | 7/2019 |
| CN | 110288933 | A | 9/2019 |
| CN | 111179793 | A | 5/2020 |

OTHER PUBLICATIONS

China Patent Office, Second Office Action dated Sep. 2, 2021, for corresponding Chinese application No. 202010009304.X.

* cited by examiner

METHOD AND DEVICE FOR DETECTING DISPLAY SUBSTRATE

CROSS REFERENCE TO RELATED APPLICATIONS

This application claims priority to Chinese patent application No. 202010009304.X, filed on Jan. 6, 2020, the contents of which are incorporated herein by reference in their entirety.

TECHNICAL FIELD

The present disclosure relates to the field of display technology, and particularly relates to a method and a device for detecting a display substrate.

BACKGROUND

At present, an organic light emitting diode (OLED) display panel may be manufactured by using an oxide thin film transistor, and in the manufacturing process, a sputtering process is generally used to deposit a metal oxide on a glass substrate, so as to manufacture each display element to form a display substrate. In the manufacturing process, an area, right opposite to a target material, on the glass substrate is a target area, and a gap area between adjacent target areas is a non-target area. Due to a metal oxide sputtering apparatus, thicknesses of a metal oxide film layer formed in the target area and the non-target area are not uniform, and accordingly, a threshold voltage of a driving transistor in a pixel driving circuit is likely to shift in the target area of the display substrate, and an on-state current is likely to change, so that the target area and the non-target area are likely to have a defect of uneven display (mura), and thus, the display substrate needs to be detected.

SUMMARY

An embodiment of the present disclosure provides a method for detecting a display substrate, which includes:

exciting a threshold voltage of a driving transistor in each pixel driving circuit in the display substrate, so that the threshold voltage of the driving transistor with a shifted threshold voltage is further shifted;

inputting a detection signal to each pixel driving circuit in the display substrate, where the detection signal is a signal for enabling the pixel driving circuit to normally operate; and judging whether the display substrate is normal or not according to a voltage output by each pixel driving circuit in response to the detection signal.

In some implementations, the display substrate has a target area and a non-target area; the target area is an area right opposite to a target material in a manufacturing process, and the non-target area is a gap area between adjacent target areas; the method includes the following steps:

exciting the threshold voltage of the driving transistor in each pixel driving circuit in the target area, so that the threshold voltage of the driving transistor with the shifted threshold voltage is further shifted;

inputting the detection signal to each of pixel driving circuits in the target area and the non-target area;

judging whether the display substrate is normal or not according to a first voltage output by the pixel driving circuit in the target area and a second voltage output by the pixel driving circuit in the non-target area.

In some implementations, the exciting the threshold voltage of the driving transistor in the pixel driving circuit in the target area includes:

inputting an excitation signal to the pixel driving circuit in the target area, and inputting a non-excitation signal to the pixel driving circuit in the non-target area, where the excitation signal simulates an operating signal of the driving transistor, and the non-excitation signal simulates a non-operating signal of the driving transistor.

In some implementations, the pixel driving circuit includes a first switching transistor, a second switching transistor, a storage capacitor, a driving transistor, and a light emitting diode, a control electrode of the first switching transistor is coupled to a scan signal terminal, a first electrode of the first switching transistor is coupled to a data signal terminal, and a second electrode of the first switching transistor is coupled to a first node;

a first electrode of the storage capacitor is coupled to the first node, and a second electrode of the storage capacitor is coupled to a second node;

a control electrode of the driving transistor is coupled to the first node, a first electrode of the driving transistor is coupled to a first power supply terminal, and a second electrode of the driving transistor is coupled to the second node;

a control electrode of the second switching transistor is coupled to a compensation control signal terminal, a first electrode of the second switching transistor is coupled to a compensation signal terminal, and a second electrode of the second switching transistor is coupled to the second node; and a first electrode of the light emitting diode is coupled to the second node, and a second electrode of the light emitting diode is coupled to a second power supply terminal.

In some implementations, the inputting the excitation signal to the pixel driving circuit in the target area includes:

inputting a first data signal to the data signal terminal of each pixel driving circuit in the target area, where the first data signal includes a high-level signal.

In some implementations, the inputting the excitation signal to the pixel driving circuit in the target area includes:

inputting a second data signal to the data signal terminal of each pixel driving circuit in the target area, where the second data signal includes a low-level signal.

In some implementations, the inputting the non-excitation signal to the pixel driving circuit in the non-target area includes:

inputting a third data signal to the data signal terminal of the pixel driving circuit in the non-target area, where a voltage of the third data signal is a ground voltage.

In some implementations, the detection signal includes a data signal for causing the pixel driving circuit to drive the display substrate for low gray scale display.

In some implementations, the judging whether the display substrate is normal according to the voltage output by each pixel driving circuit includes:

comparing and judging whether voltages output by the pixel driving circuits are consistent; and in response to that the voltages output by the pixel driving circuits are consistent, determining that the display substrate is normal.

In some implementations, the comparing and judging whether the voltages output by the pixel driving circuits are consistent includes:

approaching a liquid crystal cell to a voltage output terminal of the pixel driving circuit, where the liquid crystal cell includes a first electrode, a second electrode and a liquid crystal layer between the first electrode and the second electrode;

irradiating light to the liquid crystal cell; and comparing and judging whether patterns of outgoing light of the liquid crystal cell corresponding to the pixel driving circuits are consistent or not.

An embodiment of the present disclosure further provides a device for detecting a display substrate, including:

a timing controller configured to perform timing control on a gate driving circuit and a source driving circuit in the display substrate to excite a threshold voltage of a driving transistor in a pixel driving circuit in the display substrate through the gate driving circuit and the source driving circuit, so that the threshold voltage of the driving transistor having a shifted threshold voltage is further shifted, and then perform timing control on the gate driving circuit and the source driving circuit in the display substrate to input a detection signal, which is a signal for normally operating of the pixel driving circuit, to the pixel driving circuits in the entire display substrate through the gate driving circuit and the source driving circuit; and a processor configured to judge whether the display substrate is normal or not according to a voltage output by each pixel driving circuit in response to the detection signal.

In some implementations, the device further includes: a liquid crystal cell which includes a first electrode, a second electrode and a liquid crystal layer between the first electrode and the second electrode, and is configured to approach to a voltage output terminal of the pixel driving circuit to detect the voltage output by the pixel driving circuit in response to the detection signal, and in response to the voltages output by the pixel driving circuits being different, liquid crystal molecules in the liquid crystal layer of the liquid crystal cell are deflected differently.

In some implementations, the device further includes: a light source which is configured to irradiate the liquid crystal cell so that the liquid crystal cell emits light forming different patterns according to a difference between the voltages output by the pixel driving circuits.

DESCRIPTION OF EMBODIMENTS

In order to make the technical solutions of the present disclosure better understood, the technical solutions of the present disclosure are described in further detail below with reference to the accompanying drawings and the detailed description.

Figure 1:
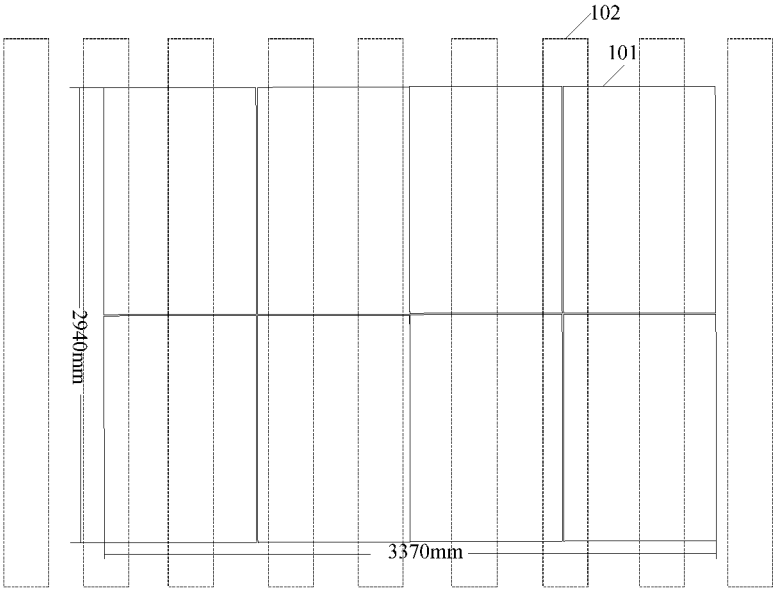
FIG. 1 is a schematic diagram illustrating a process of manufacturing a display substrate according to the related art.

In the field of display technology, a display substrate is generally formed by first fabricating a whole display mother substrate on a large-sized glass substrate and then cutting the display mother substrate. With the development of the technology, the generation number of the generation line of the display substrate is higher and higher, and the size of the manufactured display substrate is larger and larger. In order to realize the economy of cutting, one display mother board is often cut into 6 or 8 display substrates. Taking the current generation line of 10.5 as an example, a whole piece of display mother board formed on the glass substrate with a size of 2940 millimeters (mm)×3370 mm may be cut into 8 display substrates of 65 inches. FIG. 1 is a schematic diagram of a process for manufacturing a display substrate in the related art, and as shown in FIG. 1, a magnetron sputtering process may be used to bombard a target material 102 above a glass substrate 101, so that the target material 102 is sputtered, and the target material particles sputtered are deposited at corresponding positions on the glass substrate 101 to form a metal oxide thin film layer, thereby forming each display element and a display film layer, and then cutting is performed, so as to finally form a display substrate with a required size. In the manufacturing process, an area of the glass substrate 101 facing the target material 102 is a target area, and a gap area between adjacent target areas is a non-target area. Due to the metal oxide sputtering apparatus, metal oxide film layers formed in the target area and the non-target area are prone to be uneven, so that there is a certain difference between the metal oxide layers in the target area and the non-target area, and accordingly, in the target area of the display substrate, a threshold voltage of a driving transistor in a pixel driving circuit is prone to shift (for example, shift in a positive direction or a negative direction), and an on-state current of a light emitting diode is prone to change. In such case, the target area and the non-target area are likely to have a defect of uneven display (mura), and thus, the display substrate needs to be detected. The detection method in the related art has low accuracy, and even if the defect of uneven display does not appear in the detected image in the detection process, the defect of uneven display may appear in the subsequent lighting or reliability test, and thus the matching rate between the accuracy of the detection method and the accuracy of the subsequent lighting or reliability test is low. In order to solve the technical problem that the detection method in the related art is low in accuracy, an embodiment of the present disclosure provides a method and a device for detecting a display substrate. The following describes in further detail the method and the device for detecting the display substrate according to the embodiment of the present disclosure, taking the generation line of 10.5 as an example, with reference to the accompanying drawings and the detailed description.

Figure 2:
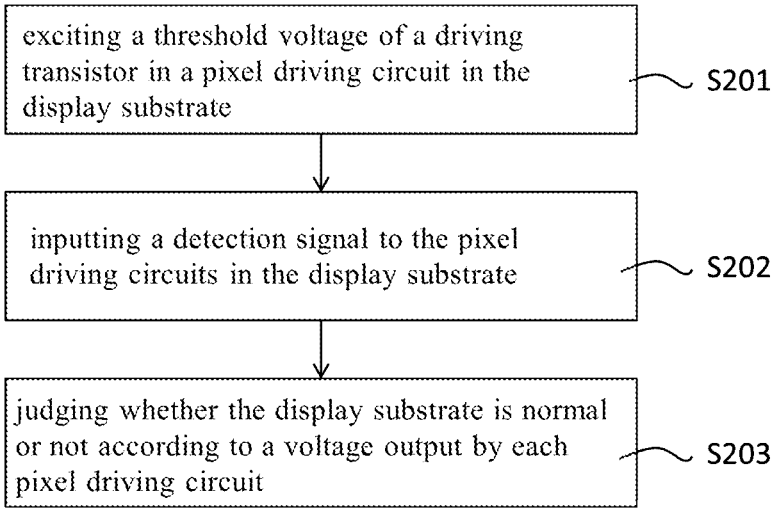
FIG. 2 to FIG. 5 are schematic flow charts of a method for detecting a display substrate according to an embodiment of the present disclosure.

FIG. 2 is a schematic flow chart of a method for detecting a display substrate according to an embodiment of the present disclosure, and as shown in FIG. 2, the method for detecting the display substrate includes the following steps S201 to S203.

S201, exciting a threshold voltage of a driving transistor in a pixel driving circuit in the display substrate.

It should be noted that, a plurality of pixel driving circuits distributed in an array are disposed on each display substrate, and are used for driving corresponding light emitting diodes in the display substrate to emit light, so as to perform display. The driving transistor in the pixel driving circuit has a certain threshold voltage, and due to the metal oxide sputtering apparatus, threshold voltages of a portion of the driving transistors in the display substrate are easily shifted (for example, shifted in a positive direction or a negative direction) and an on-state current of the light emitting diode is easily changed. In the embodiment of the present disclosure, the threshold voltage of the driving transistor in the pixel driving circuit is excited, so that the threshold voltage of the driving transistor with a shifted threshold voltage can be further shifted, and the detection accuracy of the display substrate can be improved.

S202, inputting a detection signal to the pixel driving circuits in the display substrate.

It should be noted that, the detection signal may be input to the pixel driving circuits of the display substrate by using a detection signal input method in the related art, and the driving transistor can operate under the control of the detection signal. For example, in order to find the shift of the threshold voltage of the driving transistor in the pixel driving circuit more easily, the detection signal may make the pixel driving circuit operate normally to drive the display substrate for low gray scale display. As an example, the detection signal may be a voltage signal of 1 to 5 volts. It should be understood that, since the defect of uneven display in the display substrate is caused by the shift (for example, a positive shift or a negative shift) of the threshold voltages of a portion of the driving transistors, it is necessary to ensure that the detection signal input during the detection is related to the threshold voltage of the driving transistor in the pixel driving circuit, and the specific signal and the waveform thereof are not described in detail herein.

S203, judging whether the display substrate is normal or not according to a voltage output by each pixel driving circuit.

It should be noted that, the driving transistor operates under the control of the detection signal, and in such case, a voltage is output through an output terminal of the pixel driving circuit. Due to the manufacturing of the metal oxide film layer, the threshold voltages of a portion of the driving transistors may be shifted (e.g., in a positive or negative direction), and thus, voltages output by a portion of the pixel driving circuits may be different. In addition, in the embodiment of the present disclosure, before the detection signal is input, the threshold voltage of the driving transistor is excited, and the threshold voltage of the driving transistor with the shifted threshold voltage is further shifted, so that the voltage output by the corresponding pixel driving circuit is obviously changed under the control of the detection signal, thereby improving the detection accuracy of the display substrate.

Figure 3:
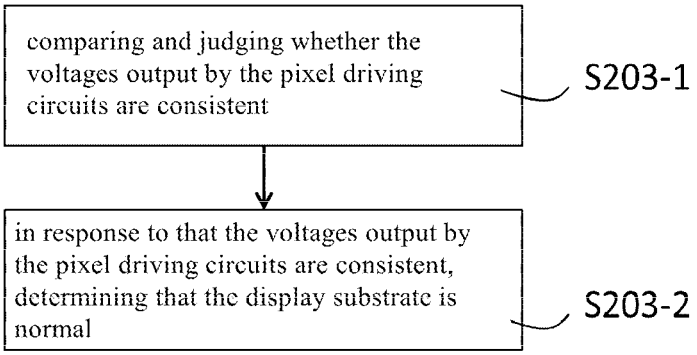

In some implementations, as shown in FIG. 3, S203 may include: S203-1, comparing and judging whether the voltages output by the pixel driving circuits are consistent; and S203-2, in response to that the voltages output by the pixel driving circuits are consistent, determining that the display substrate is normal.

Figure 4:
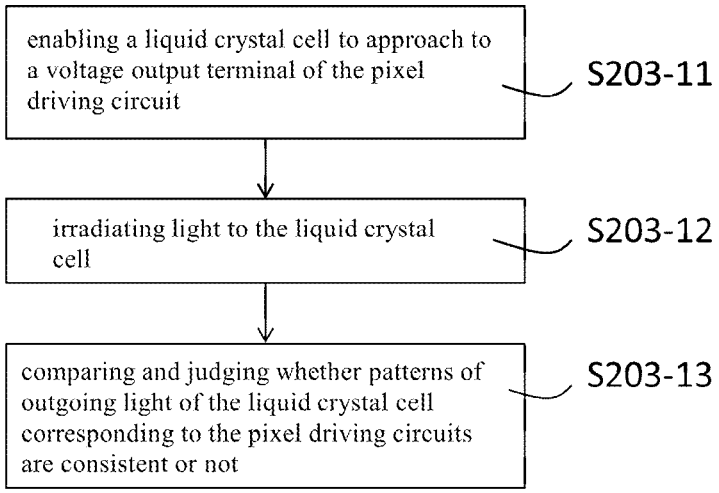

In some implementations, as shown in FIG. 4, S203-1 may include: S203-11, enabling a liquid crystal cell to approach to a voltage output terminal of the pixel driving circuit, where the liquid crystal cell includes a first electrode, a second electrode and a liquid crystal layer between the first electrode and the second electrode; S203-12, irradiating light to the liquid crystal cell; and S203-13, comparing and judging whether patterns of outgoing light of the liquid crystal cell corresponding to the pixel driving circuits are consistent or not.

Specifically, in S203-1, the liquid crystal cell may be located at a distance of about 5 μm to 15 μm from the voltage output terminal of the pixel driving circuit, but the disclosure is not limited thereto, as long as the voltage output by the pixel driving circuit through the voltage output terminal thereof have a distinguishable effect on a capacitance between the first electrode and the second electrode in the liquid crystal cell (that is, have a distinguishable effect on the deflection of liquid crystal molecules in the liquid crystal layer of the liquid crystal cell).

For example, one of the first electrode and the second electrode in the liquid crystal cell may be a reflective electrode, the other may be a transparent electrode, and a light source may be used to irradiate the transparent electrode side of the liquid crystal cell, and then reflected light emitted from the liquid crystal cell is received, and then whether patterns of the reflected light emitted from the liquid crystal cell corresponding to the pixel driving circuits are consistent or not is judged.

Certainly, the first electrode and the second electrode in the liquid crystal cell may be both transparent electrodes, and a light source may be used to irradiate one side of the liquid crystal cell, and then the light emitted from the other side of the liquid crystal cell is received, and then whether patterns of the light emitted from the liquid crystal cell corresponding to the pixel driving circuits are consistent is judged.

It should be noted that, whether the patterns of the outgoing light of the liquid crystal cell corresponding to the pixel driving circuits are consistent or not may be analyzed and determined by a processor, and whether the patterns of the outgoing light of the liquid crystal cell corresponding to the pixel driving circuits are consistent or not may also be analyzed and determined by other reasonable modes according to actual needs.

If the patterns of the reflected light emitted by the liquid crystal cell corresponding to the pixel driving circuits are consistent, the display substrate is normal, and the defect of uneven display brightness is not prone to occur in subsequent tests and practical applications; if the patterns of the reflected light emitted from the liquid crystal cell corresponding to the pixel driving circuits are not consistent, the display substrate is prone to have the defect of uneven display brightness, and the display substrate can be eliminated to save the manufacturing cost.

According to the method for detecting the display substrate according to the embodiment of the present disclosure, the threshold voltage of the driving transistor in the pixel driving circuit of the display substrate is excited, so that the threshold voltage of the driving transistor with a shifted threshold voltage is further shifted, and then the detection signal is input to the display substrate, so that the voltage output by the corresponding pixel driving circuit is obviously changed, and therefore, the detection for the display substrate can be more accurate, and an effective detection of defect of uneven display of the display substrate is realized. Meanwhile, the display substrate which is prone to defect of uneven display can be directly eliminated, and the effective interception of the defective substrate is realized, so that the matching rate between the accuracy of the detection and the accuracy of the subsequent lighting or reliability test is improved, and the manufacturing cost of the display substrate is further saved.

Figure 5:
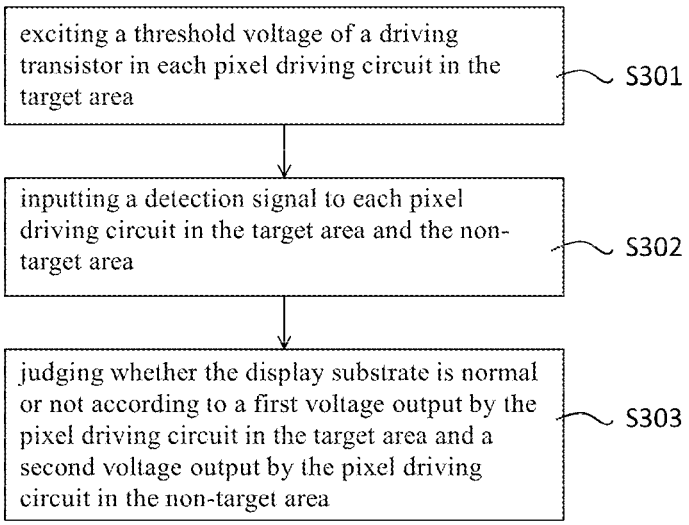

In some implementations, the method for detecting the display substrate according to the embodiment of the present disclosure may be applied to the display substrate formed by the manufacturing method shown in FIG. 1, and specifically, the method for detecting the display substrate is shown in FIG. 5, and specifically includes the following steps S301 to S303.

S301, exciting a threshold voltage of a driving transistor in each pixel driving circuit in the target area.

S302, inputting a detection signal to each pixel driving circuit in the target area and the non-target area.

S303, judging whether the display substrate is normal or not according to a first voltage output by the pixel driving circuit in the target area and a second voltage output by the pixel driving circuit in the non-target area.

It should be noted that, the display substrate includes a target area and a non-target area, in the manufacturing process of the display substrate, due to the metal oxide sputtering apparatus, a problem easily occurs in the thickness of the metal oxide film layer in the target area, so that the threshold voltage of the driving transistor in the target area is easily shifted (for example, in a positive or negative direction), and the threshold voltage of the driving transistor in the non-target area is not easily shifted. In the embodiment of the present disclosure, only the threshold voltage of the driving transistor in the target area may be excited, but the threshold voltage of the driving transistor in the non-target area is not excited, so that the threshold voltage of the driving transistor with the shifted threshold voltage is further shifted, and thus the difference between the threshold voltages of the driving transistors in the target area and the non-target area is more significant. In such way, when the same detection signal is input to the pixel driving circuits in the target area and the non-target area, the pixel driving circuits in the target area and the non-target area can output the first voltage and the second voltage respectively, the first voltage is significantly different from the second voltage, and thus the accuracy of the detection for the display substrate can be improved. Meanwhile, the display substrate which is prone to the defect of uneven display can be directly eliminated, and the effective interception of the defective substrate is realized, so that the matching rate between the accuracy of the detection and the accuracy of the subsequent lighting or reliability test is improved, and the manufacturing cost of the display substrate is further saved.

In some implementations, the exciting the threshold voltage of the driving transistor in the pixel driving circuit in the target area in S301 includes: an excitation signal is input to the pixel driving circuit in the target area, and a non-excitation signal is input to the pixel driving circuit in the non-target area.

It should be noted that, the excitation signal may be independently input to the pixel driving circuit in the target area, and the non-excitation signal may be independently input to the pixel driving circuit in the non-target area, where the excitation signal may be a signal related to the threshold voltage of the driving transistor, and certainly, the pixel driving circuit in the non-target area may not be processed at all, so that the threshold voltage of the driving transistor, with the shifted threshold voltage, in the target area is further shifted (for example, shifted in a positive or negative direction), so that the difference between the threshold voltages of the driving transistors in the target area and the non-target area is increased, and the detection accuracy is further improved.

Figure 6:
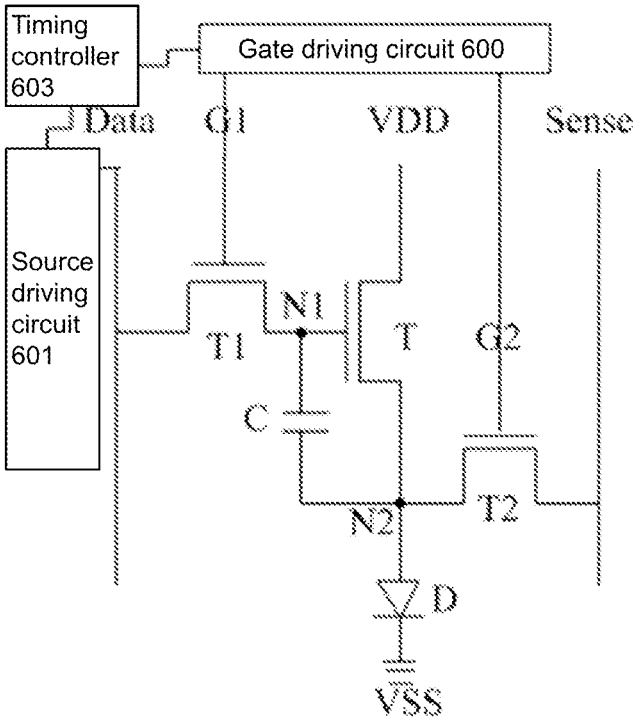
FIG. 6 is a schematic structural diagram of a pixel driving circuit according to an embodiment of the present disclosure.

FIG. 6 is a schematic structural diagram of a pixel driving circuit according to an embodiment of the present disclosure, and as shown in FIG. 6, the pixel driving circuit includes: a first switching transistor T1, a second switching transistor T2, a storage capacitor C, a driving transistor T, and a light emitting diode D.

The first switching transistor T1 has a control electrode coupled to a scan signal terminal G1, a first electrode coupled to a data signal terminal Data, and a second electrode coupled to a first node N1. A first electrode of the storage capacitor C is coupled to the first node N1, and a second electrode of the storage capacitor C is coupled to a second node N2. The driving transistor T has a control electrode coupled to the first node N1, a first electrode coupled to a first power supply terminal VDD, and a second electrode coupled to the second node N2. The second switching transistor T2 has a control electrode coupled to a compensation control signal terminal G2, a first electrode coupled to a compensation signal terminal Sense, and a second electrode coupled to the second node N2. A first electrode of the light emitting diode D is coupled to the second node N2, and a second electrode is coupled to a second power supply terminal VSS.

As shown in FIG. 6, signals may be supplied to the scan signal terminal G1 and the compensation control signal terminal G2 through a gate driving circuit 600, signals may be supplied to the data signal terminal Data through a source driving circuit 601, and in addition, the gate driving circuit 600 and the source driving circuit 601 may be timing-controlled through a timing controller 603.

It is to be understood that, in the embodiment of the present disclosure, the source and the drain of each transistor may be interchanged under certain conditions, and thus, the source and the drain of each transistor are not distinguished from each other in the description of the connection relationship. In the embodiment of the present disclosure, in order to distinguish the source and the drain of the transistor, one of them is referred to as a first electrode, the other is referred to as a second electrode, and the gate of the transistor is referred to as a control electrode. In addition, according to characteristics of transistors, the transistors can be divided into N-type transistors and P-type transistors, for the N-type transistors, the first electrode is the source of the N-type transistor, the second electrode is the drain of the N-type transistor, and when a high-level is input to the gate, a current is allowed between the source and the drain, and for the P-type transistors, the opposite is true.

The display substrate in the embodiment of the present disclosure includes a plurality of pixel driving circuits distributed in an array as shown in FIG. 6, and the following will take the pixel driving circuit shown in FIG. 6 as an example to further describe in detail the method for detecting the display substrate according to the embodiment of the present disclosure.

In some implementations, the inputting the excitation signal to the pixel driving circuit in the target area includes: inputting a first data signal to a data signal terminal of the pixel driving circuit in the target area, where the first data signal includes a high-level signal.

Figure 7:
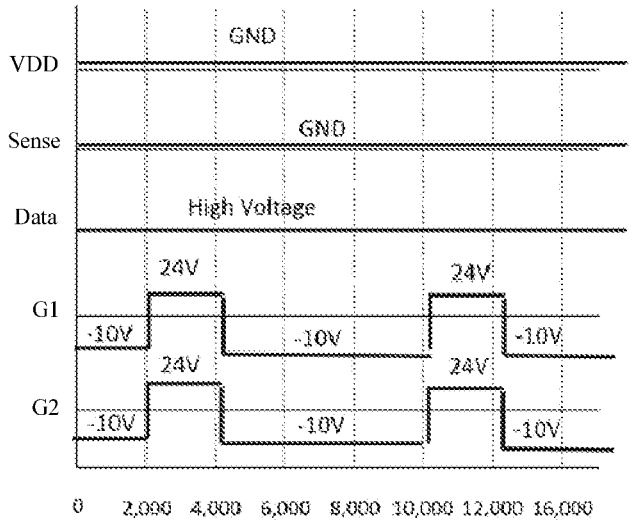
FIG. 7 is a waveform diagram of an excitation signal according to an embodiment of the present disclosure.

It should be noted that, the waveform of the excitation signal may be as shown in FIG. 7, and the inputting the excitation signal to the pixel driving circuit in the target area may specifically include: inputting the first data signal to the data signal terminal Data of the pixel driving circuit in the target area, where the first data signal may be a high-level signal; the scan signal terminal G1 inputs a scan signal, which can control the first switching transistor T1 to be turned on or off according to a preset timing; the first power supply terminal VDD inputs a first power supply voltage, which may be a ground voltage (e.g., 0 volt); the compensation control signal terminal G2 may input a compensation control signal, which can control the second switching transistor T2 to be turned on or off; the compensation signal terminal Sense may input a compensation signal, and the voltage of the compensation signal may be a ground voltage (e.g., 0 volt). In such way, the first data signal (i.e., the high-level signal) may simulate the operating signal of the driving transistor T to excite the threshold voltage of the driving transistor T in the target area, so that the threshold voltage of the driving transistor T with the shifted threshold voltage (e.g., shifted in a positive direction) is further shifted, and the difference between the threshold voltages of the driving transistors in the target area and the non-target area is increased, thereby making the detection of the display substrate more accurate and realizing the effective detection of the defect of uneven display of the display substrate.

In some implementations, the inputting the excitation signal to the pixel driving circuit in the target area includes: inputting a second data signal to the data signal terminal of the pixel driving circuit in the target area, where the second data signal includes a low-level signal.

Figure 8:
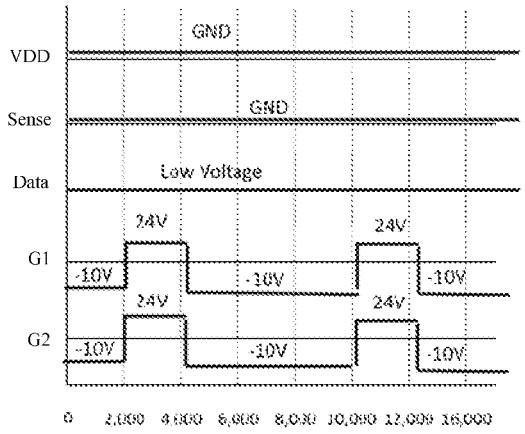
FIG. 8 is another waveform diagram of an excitation signal according to an embodiment of the present disclosure.

It should be noted that, the waveform of the excitation signal may be as shown in FIG. 8, and the inputting the excitation signal to the pixel driving circuit in the target area may specifically include: inputting the second data signal to the data signal terminal Data of the pixel driving circuit in the target area, where the second data signal may be a low-level signal; the scan signal terminal G1 inputs a scan signal, which can control the first switching transistor T1 to be turned on or off according to a preset timing; the first power supply terminal VDD inputs a first power supply voltage, which may be a ground voltage (e.g., 0 volt); the compensation control signal terminal G2 may input a compensation control signal, which can control the second switching transistor T2 to be turned on or off; the compensation signal terminal Sense may input a compensation signal, and the voltage of the compensation signal may be a ground voltage (e.g., 0 volt). In such way, the second data signal (i.e., the low-level signal) can simulate the operating signal of the driving transistor T, and excite the threshold voltage of the driving transistor T in the target area, so that the threshold voltage of the driving transistor T with the shifted threshold voltage (e.g., shifted in a negative direction) is further shifted, and the difference between the threshold voltages of the driving transistors in the target area and the non-target area is increased, so that the detection of the display substrate can be more accurate, and the effective detection of the defect of the uneven display of the display substrate can be achieved.

Figure 9:
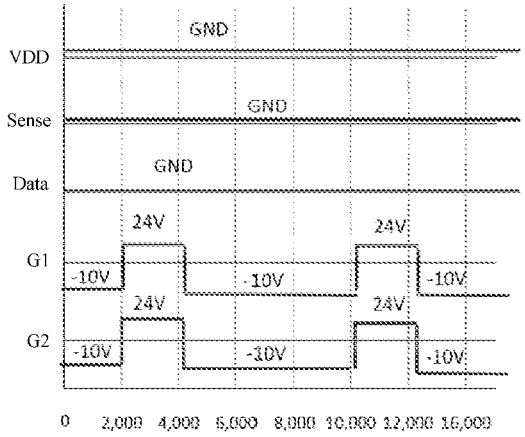
FIG. 9 is a waveform diagram of a non-excitation signal according to an embodiment of the present disclosure.

In the embodiment of the present disclosure, the threshold voltage of the driving transistor T in the non-target area may not be excited, and thus the excitation signal may not be input to the driving transistor T in the non-target area. Certainly, a non-excitation signal may be input to the pixel driving circuit in the non-target area, and the non-excitation signal may be as shown in FIG. 9, and the method may specifically include: inputting a third data signal to the data signal terminal Data of the pixel driving circuit in the non-target area, where the voltage of the third data signal may be a ground voltage (e.g., 0 volt); the scan signal terminal G1 inputs a scan signal, which can control the first switching transistor T1 to be turned on or off according to a preset timing; the first power supply terminal VDD inputs a first power supply voltage, which may be a ground voltage (e.g., 0 volt); the compensation control signal terminal G2 may input a compensation control signal, which can control the second switching transistor T2 to be turned on or off; the compensation signal terminal Sense may input a compensation signal, and the voltage of the compensation signal may be a ground voltage (e.g., 0 volt). In such way, the voltage of the third data signal is the ground voltage (e.g., 0 volt), and the non-operating signal of the driving transistor T can be simulated without exciting the threshold voltage of the driving transistor T in the non-target area, so that the threshold voltage of the driving transistor T in the non-target area can be used as a reference, and the difference between the threshold voltages of the driving transistors T in the target area and the non-target area is increased, thereby the detection of the display substrate can be more accurate, and the effective detection of the defect of the uneven display of the display substrate can be realized.

In some implementations, the first switching transistor T1 and the second switching transistor T2 in the embodiment of the present disclosure may be both N-type transistors, and the voltage turning on the transistors may be a high-level voltage, which may be 0 volt to 30 volts (e.g., may be 24 volts), and the voltage turning off the transistors may be a low-level voltage, which may be −20 volts to −5 volts (e.g., may be −10 volts).

Note that, a high-level voltage, for example, 24 volts, may be input to control electrodes of the first switching transistor T1 and the second switching transistor T2, so that both the first switching transistor T1 and the second switching transistor T2 are turned on. A low-level voltage, which may be −10 volts for example, may be input to control electrodes of the first switching transistor T1 and the second switching transistor T2, so that both the first switching transistor T1 and the second switching transistor T2 are turned off. It is to be understood that in the embodiment of the present disclosure, the first switching transistor T1 and the second switching transistor T2 may also be P-type transistors, and the implementation principle thereof is similar to above and will not be described herein again.

In addition, the first data signal may be a high-level signal of 15 volts to 30 volts.

It should be understood that, in order to ensure an effective control for the first switching transistor T1 and the second switching transistor T2, the level voltage of the second data signal may be higher than the level voltage of the scan signal input from the scan signal terminal G1.

For example, when a low-level voltage of −10 volts is input to the control electrode of the first switching transistor T1, the second data signal may be a low-level signal of −8 volts to −2 volts.

Figure 10:
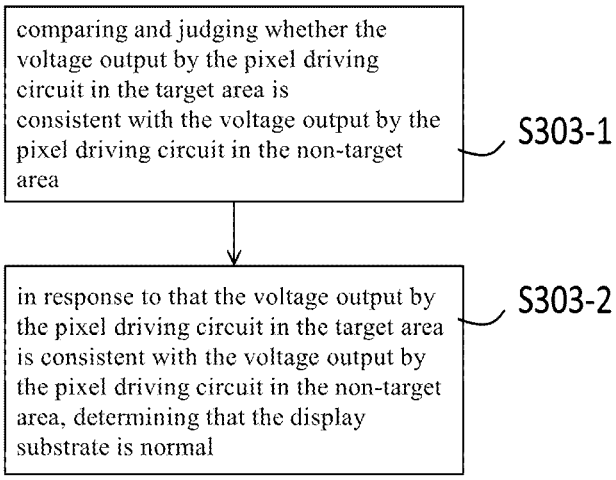
FIG. 10 to FIG. 11 are schematic flow charts of a method for detecting a display substrate according to an embodiment of the present disclosure.

In some implementations, as shown in FIG. 10, S303 may include steps of: S303-1, comparing and judging whether the voltage output by the pixel driving circuit in the target area is consistent with the voltage output by the pixel driving circuit in the non-target area; and S303-2, in response to that the voltage output by the pixel driving circuit in the target area is consistent with the voltage output by the pixel driving circuit in the non-target area, determining that the display substrate is normal.

Figure 11:
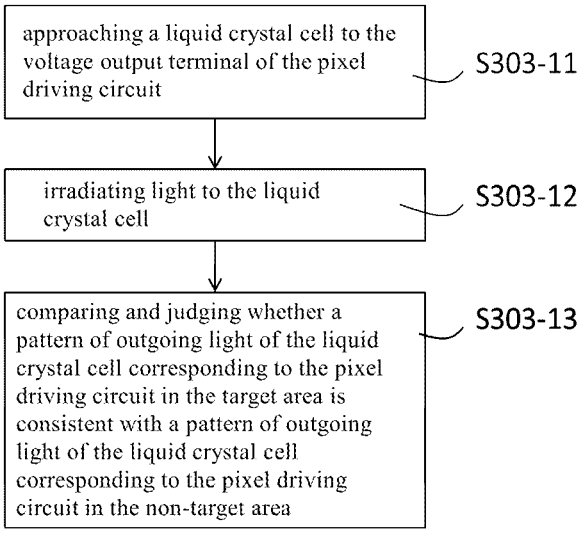

In some implementations, as shown in FIG. 11, S303-1 may include steps: S303-11, approaching a liquid crystal cell to the voltage output terminal (e.g., the second node N2 shown in FIG. 6) of the pixel driving circuit, where the liquid crystal cell includes a first electrode, a second electrode, and a liquid crystal layer between the first electrode and the second electrode; S303-12, irradiating light to the liquid crystal cell; and S303-13, comparing and judging whether a pattern of outgoing light of the liquid crystal cell corresponding to the pixel driving circuit in the target area is consistent with a pattern of outgoing light of the liquid crystal cell corresponding to the pixel driving circuit in the non-target area.

Specifically, in S303-1, the liquid crystal cell may be located at a distance of about 5 μm to 15 μm from the voltage output terminal of the pixel driving circuit, but the present disclosure is not limited thereto, as long as the voltage output by the pixel driving circuit through the voltage output terminal thereof can have a distinguishable effect on the capacitance between the first electrode and the second electrode in the liquid crystal cell (that is, can have a distinguishable effect on the deflection of liquid crystal molecules in the liquid crystal layer of the liquid crystal cell).

For example, one of the first electrode and the second electrode in the liquid crystal cell may be a reflective electrode, the other may be a transparent electrode, and a light source may be used to irradiate the transparent electrode side of the liquid crystal cell, and then reflected light emitted from the liquid crystal cell is received, and then whether a pattern of the reflected light emitted from the liquid crystal cell corresponding to the pixel driving circuit in the target area and a pattern of the reflected light emitted from the liquid crystal cell corresponding to the pixel driving circuit in the non-target area are consistent with each other is judged.

Alternatively, the first electrode and the second electrode in the liquid crystal cell both may be transparent electrodes, and a light source may be used to irradiate one side of the liquid crystal cell, the light emitted from the other side of the liquid crystal cell is received, and whether a pattern of light emitted from the liquid crystal cell corresponding to the pixel driving circuit in the target area is consistent with a pattern of light emitted from the liquid crystal cell corresponding to the pixel driving circuit in the non-target area is then judged.

It should be noted that whether the pattern of the outgoing light of the liquid crystal cell corresponding to the pixel driving circuit in the target area is consistent with the pattern of the outgoing light of the liquid crystal cell corresponding to the pixel driving circuit in the non-target area may be analyzed and determined by a processor, or whether the pattern of the outgoing light of the liquid crystal cell corresponding to the pixel driving circuit in the target area is consistent with the pattern of the outgoing light of the liquid crystal cell corresponding to the pixel driving circuit in the non-target area may be analyzed and determined by other reasonable manners according to actual needs.

If the pattern of the outgoing light of the liquid crystal cell corresponding to the pixel driving circuit in the target area is consistent with the pattern of outgoing light of the liquid crystal cell corresponding to the pixel driving circuit in the non-target area, the display substrate is normal, and the defect of uneven display brightness is not prone to occur in subsequent tests and practical applications; if the pattern of the outgoing light of the liquid crystal cell corresponding to the pixel driving circuit in the target area is not consistent with the pattern of the outgoing light of the liquid crystal cell corresponding to the pixel driving circuit in the non-target area, the display substrate is indicated to be prone to having the defect of uneven display brightness, and therefore the display substrate can be eliminated, and the manufacturing cost is saved.

Figure 12A:
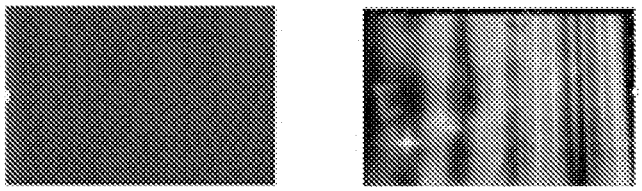
FIG. 12*a* is a diagram illustrating a detection result of a display substrate according to the related art.
Figure 12B:
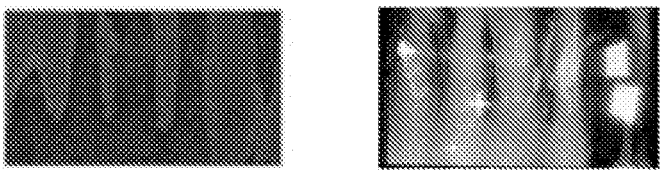
FIG. 12*b* is a schematic diagram illustrating a detection result of a display substrate according to an embodiment of the present disclosure.

FIG. 12*a* is a schematic diagram illustrating a detection result of a display substrate in the related art, which is detected by using a detection method in the related art, as shown in the left diagram of FIG. 12*a*, in the detection process, a defect of uneven display does not occur in the target area and the non-target area of the display substrate, however, as shown in the right diagram of FIG. 12*a*, in practical applications, the defect of uneven display still occurs in the display substrate. FIG. 12*b* is a schematic diagram of a detection result of a display substrate according to an embodiment of the present disclosure, the same display substrate is detected by using the detection method according to the embodiment of the present disclosure, as shown in the left diagram of FIG. 12*b*, the threshold voltage of the driving transistor in the target area is excited, and during the detection process, a defect of uneven display occurs in the target area and the non-target area of the display substrate, as shown in the right diagram of FIG. 12*b*, in the practical application, the defect of uneven display also occurs in the display substrate. Therefore, it can be seen that, with the method for detecting the display substrate according to the embodiment of the present disclosure, after the threshold voltage of the driving transistor in the target area is excited, the detection signal is input to the pixel driving circuits in the entire display substrate to detect, so that the difference between the threshold voltages of the driving transistors in the target area and the non-target area is increased, and the difference between the first voltage and the second voltage output by the pixel driving circuits in the target area and the non-target area is relatively obvious, thereby enabling the detection of the display substrate to be more accurate, and further implementing effective detection of uneven display of the display substrate. Meanwhile, the display substrate which is prone to the defect of uneven and poor display can be directly eliminated, and the effective interception of the bad defective substrate is realized, so that the matching rate between the accuracy of the detection and the accuracy in the subsequent lighting or reliability test is improved, and the manufacturing cost of the display substrate is further saved.

Figure 13:
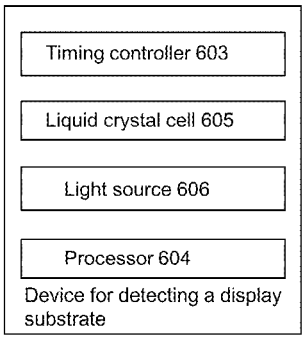
FIG. 13 is a schematic structural diagram of a device for detecting a display substrate according to an embodiment of the present disclosure.

Based on the same concept, an embodiment of the present disclosure provides a device for detecting a display substrate, and FIG. 13 is a schematic structural diagram of the device for detecting the display substrate according to an embodiment of the present disclosure, as shown in FIG. 13, the device includes: a timing controller 603 configured to perform timing control on the gate driving circuit 600 and the source driving circuit 601 in the display substrate to excite the threshold voltage of the driving transistor in the pixel driving circuit of the display substrate through the gate driving circuit 600 and the source driving circuit 601, so that the threshold voltage of the driving transistor having the shifted threshold voltage is further shifted, and then perform timing control on the gate driving circuit 600 and the source driving circuit 601 in the display substrate to input a detection signal to the pixel driving circuits in the entire display substrate through the gate driving circuit 600 and the source driving circuit 601, the detection signal being a signal for normally operating the pixel driving circuit; and a processor 604 configured to determine whether the display substrate is normal according to the voltage output by each of the pixel driving circuits in response to the detection signal.

In some implementations, as shown in FIG. 13, the device further includes: a liquid crystal cell 605, where the liquid crystal cell 605 includes a first electrode 111, a second electrode 112, and a liquid crystal layer 113 between the first electrode 111 and the second electrode 112, and is configured to detect a voltage output by the pixel driving circuit in response to the detection signal by approaching to a voltage output terminal of the pixel driving circuit, and when the voltage output by the pixel driving circuit varies, liquid crystal molecules in the liquid crystal layer 113 of the liquid crystal cell 605 are deflected differently.

In some implementations, the device further includes: a light source 606, where the light source 606 irradiates the liquid crystal cell 605, and the liquid crystal cell 605 can emit light capable of forming different patterns according to the voltage output by the pixel driving circuit.

It should be noted that the device for detecting the display substrate according to the embodiment of the present disclosure can perform steps S201 to S203 or S301 to S303 in the method for detecting the display substrate in the above embodiment, and an implementation principle of the device for detecting the display substrate is similar to that of the method for detecting the display substrate in the above embodiment, and is not described herein again.

It should be understood that reference to "be consistent" in the present disclosure means being substantially consistent, that is, even if there is a difference, the difference may be negligible or within a tolerance range, it may be considered to be consistent; accordingly, "not consistent" means that there is a non-negligible difference, for example, if there is a difference which is greater than a preset threshold, it may be considered to be not consistent, and the preset threshold herein may be calculated or preset according to needs or practical experiences, and the present disclosure is not particularly limited thereto.

It is to be understood that the above embodiments and implementations are merely illustrative of exemplary embodiments and implementations that have been employed to illustrate the principles of the present disclosure, which, however, is not to be taken as limiting of the present disclosure. It will be apparent to those skilled in the art that various changes and modifications can be made therein without departing from the spirit and scope of the present disclosure, and these changes and modifications are to be considered within the scope of the present disclosure.

The invention claimed is:

1. A method for detecting a display substrate, comprising:

exciting a threshold voltage of a driving transistor in each pixel driving circuit in the display substrate by inputting an excitation signal to the pixel driving circuit, so that the threshold voltage of the driving transistor with a shifted threshold voltage is further shifted, wherein the excitation signal simulates an operating signal of the driving transistor;

inputting a detection signal to each pixel driving circuit in the display substrate, wherein the detection signal is a signal for enabling the pixel driving circuit to normally operate; and judging whether the display substrate is normal or not according to a voltage output by each pixel driving circuit, wherein the judging whether the display substrate is normal or not according to the voltage output by each pixel driving circuit comprises:

comparing and judging whether voltages output by pixel driving circuits are consistent, and in response to that the voltages output by the pixel driving circuits are consistent, determining that the display substrate is normal.

2. The method of claim 1, wherein the display substrate has a target area and a non-target area; the target area is an area opposite to a target material in a manufacturing process, and the non-target area is a gap area between adjacent target areas; the method comprises:

exciting the threshold voltage of the driving transistor in each pixel driving circuit in the target area, so that the threshold voltage of the driving transistor with the shifted threshold voltage is further shifted;

inputting a detection signal to each of pixel driving circuits in the target area and the non-target area; and judging whether the display substrate is normal or not according to a first voltage output by the pixel driving circuit in the target area and a second voltage output by the pixel driving circuit in the non-target area.

3. The method of claim 2, wherein the exciting the threshold voltage of the driving transistor in the pixel driving circuit in the target area comprises:

inputting the excitation signal to each pixel driving circuit in the target area, and inputting a non-excitation signal to each pixel driving circuit in the non-target area, wherein the non-excitation signal simulates a non-operating signal of the driving transistor.

4. The method of claim 3, wherein the pixel driving circuit comprises a first switching transistor, a second switching transistor, a storage capacitor, a driving transistor, and a light emitting diode, a control electrode of the first switching transistor is coupled to a scan signal terminal, a first electrode of the first switching transistor is coupled to a data signal terminal, and a second electrode of the first switching transistor is coupled to a first node;

a first electrode of the storage capacitor is coupled to the first node, and a second electrode of the storage capacitor is coupled to a second node;

a control electrode of the driving transistor is coupled to the first node, a first electrode of the driving transistor is coupled to a first power supply terminal, and a second electrode of the driving transistor is coupled to the second node;

a control electrode of the second switching transistor is coupled to a compensation control signal terminal, a first electrode of the second switching transistor is coupled to a compensation signal terminal, and a second electrode of the second switching transistor is coupled to the second node; and a first electrode of the light emitting diode is coupled to the second node, and a second electrode of the light emitting diode is coupled to a second power supply terminal.

5. The method of claim 4, wherein the inputting the excitation signal to the pixel driving circuit in the target area comprises:

inputting a first data signal to the data signal terminal of each pixel driving circuit in the target area, wherein the first data signal comprises a high-level signal.

6. The method of claim 4, wherein the inputting the excitation signal to the pixel driving circuit in the target area comprises:

inputting a second data signal to the data signal terminal of each pixel driving circuit in the target area, wherein the second data signal comprises a low-level signal.

7. The method of claim 4, wherein the inputting the non-excitation signal to the pixel driving circuit in the non-target area comprises:

inputting a third data signal to the data signal terminal of the pixel driving circuit in the non-target area, wherein the third data signal is at a ground voltage.

8. The method of claim 1, wherein the detection signal comprises a data signal for causing the pixel driving circuit to drive the display substrate for low gray scale display.

9. The method of claim 1, wherein the comparing and judging whether the voltages output from the pixel driving circuits are consistent comprises:

approaching a liquid crystal cell to a voltage output terminal of the pixel driving circuit, wherein the liquid crystal cell comprises a first electrode, a second electrode and a liquid crystal layer between the first electrode and the second electrode;

irradiating light to the liquid crystal cell; and comparing and judging whether patterns of outgoing light of the liquid crystal cell corresponding to the pixel driving circuits are consistent or not.

10. A device for detecting a display substrate, comprising:

a timing controller configured to perform timing control on a gate driving circuit and a source driving circuit in the display substrate to input an excitation signal to the pixel driving circuit to excite a threshold voltage of a driving transistor in a pixel driving circuit in the display substrate through the gate driving circuit and the source driving circuit, so that the threshold voltage of the driving transistor having a shifted threshold voltage is further shifted, and then perform timing control on the gate driving circuit and the source driving circuit in the display substrate to input a detection signal, which is a signal for normally operating the pixel driving circuit, to pixel driving circuits in the display substrate through the gate driving circuit and the source driving circuit, wherein the excitation signal simulates an operating signal of the driving transistor; and a processor configured to judge whether the display substrate is normal or not according to voltages output by the pixel driving circuits in response to the detection signal, and determine that the display substrate is normal in response to the voltages output by the pixel driving circuits being consistent.

11. The device of claim 10, further comprising:

a liquid crystal cell comprising a first electrode, a second electrode and a liquid crystal layer between the first electrode and the second electrode, and configured to approach to a voltage output terminal of the pixel driving circuit to detect the voltage output by the pixel driving circuit in response to the detection signal, and in response to that the voltages output by the pixel driving circuits being different, liquid crystal molecules in the liquid crystal layer of the liquid crystal cell are deflected differently.

12. The device of claim 11, further comprising:

a light source irradiating the liquid crystal cell so that the liquid crystal cell emits light capable of forming different patterns according to differences in voltages output by the pixel driving circuits.

* * * * *